United States Patent [19]

Adamski

[11] 4,345,182

[45] Aug. 17, 1982

[54] ELECTRODE HAVING SPIRAL-SHAPED ELECTRICALLY CONDUCTING REGIONS THEREIN USEFUL AS AN ANODE IN ELECTRON BEAM DISCHARGE DEVICES

[75] Inventor: John L. Adamski, Bothell, Wash.

[73] Assignee: The Boeing Company, Seattle, Wash.

[21] Appl. No.: 155,520

[22] Filed: Jun. 2, 1980

[51] Int. Cl.[3] ..... H01J 1/46; H01J 17/04; H01J 19/38; H01J 19/40

[52] U.S. Cl. ..... 313/348; 313/442; 313/448; 313/452

[58] Field of Search ..... 313/348, 336, 441, 442, 313/447, 448, 450, 452, 458, 418, 419

[56] References Cited

U.S. PATENT DOCUMENTS

| | | | |
|---|---|---|---|
| 2,126,286 | 8/1938 | Schlesinger | 313/452 X |
| 2,341,764 | 2/1944 | DeGier | 313/358 |
| 2,608,668 | 8/1952 | Hines | 313/442 X |
| 2,781,171 | 2/1957 | Hagen | 313/419 X |
| 3,045,141 | 7/1962 | Epstein et al. | 313/448 |
| 3,356,880 | 12/1967 | Webster | 313/452 |
| 3,392,300 | 7/1968 | Arnaud et al. | 313/348 |
| 3,548,250 | 12/1970 | Van Roosmalen et al. | 313/448 |
| 3,593,053 | 7/1971 | Mueller | 313/458 |
| 3,934,168 | 1/1976 | Hardman et al. | 313/348 |

*Primary Examiner*—Saxfield Chatmon, Jr.
*Attorney, Agent, or Firm*—Cole, Jensen & Puntigam

[57] ABSTRACT

The electrode is circular in configuration, with a central opening, so that it has inner and outer rims. The electrode structure comprises a plurality of spiral-shaped vanes of conducting material which are separated by relatively thin slit-like openings. The spiral vanes begin at an inner boundary which is close to the inner rim of the electrode and rotate approximately one-half turn to the outer rim of the electrode. A portion of the electron beam, which is typically produced from a cathode energized by a high voltage source, strikes the electrode near the central opening, and travels along the vanes of the electrode to ground, thereby establishing a plurality of spiral current paths in the electrode. These spiral currents create a magnetic field about the center of the anode in the region of the electron beam, focusing the remainder of electron beam through the opening in the electrode.

11 Claims, 2 Drawing Figures

ELECTRODE HAVING SPIRAL-SHAPED ELECTRICALLY CONDUCTING REGIONS THEREIN USEFUL AS AN ANODE IN ELECTRON BEAM DISCHARGE DEVICES

BACKGROUND OF THE INVENTION

This invention relates generally to the art of electron beam discharge devices, including high energy charged particle accelerators, and more particularly concerns a particular anode structure useful in such devices.

In an electron beam discharge device in general, a cathode is energized by a high voltage, resulting in electrons being field emitted from the cathode and accelerated across a vacuum gap to an anode, which typically has an opening through which a portion of the electron beam from the cathode moves. Those electrons in the beam which do not move through the opening strike the anode around the opening and flow through the anode to ground.

The focusing of the electron beam at the anode is accomplished primarily by the opening in the anode, and thus, the shape and quality of the beam depends to a large extent upon the size, configuration and other characteristics of the opening. However, there are inherent limitations on this technique with respect to the focusing and quality of the beam, since it is a passive focusing technique. It is often desirable that the electron beam have a better uniformity and a sharper focus than is possible through just the passive use of the anode opening.

Accordingly, it is a general object of the present invention to provide an electrode useful as an anode in an electron beam discharge device which corrects one or more of the disadvantages of the prior art noted above.

It is another object of the present invention to provide such an electrode which provides positive control over the focusing of the electron beam generated by an electron beam discharge device.

It is a further object of the present invention to provide such an electrode which uses a portion of the electron beam itself to provide the desired positive control.

It is an additional object of the present invention to provide such an electrode which provides a positive control which varies in strength in accordance with the energy level of the electron beam.

It is a still further object of the present invention to provide such an electrode which produces minimal adverse affects on the electron beam downstream of the electrode.

It is yet another object of the present invention to provide such an electrode which may be retrofitted to existing electron beam devices.

SUMMARY OF THE INVENTION

Accordingly, the present invention comprises an electrode which is useful as an anode in an electron beam discharge device, which is an apparatus in which electrons are emitted from a cathode source in the form of an electron beam. The electrode is itself groundable to the discharge device, and has an opening through which a portion of the electron beam is directed. The electrode has regions of electrical conductance separated by regions of electrical nonconductance, the regions of electrical conductance being angularly displaced between the beginning points of the regions, which are located relatively toward the opening and the termination points of the regions, which are located relatively away from the opening, so that, in operation, current established in the regions of electrical conductance, by a portion of the electrons from the electron beam striking the anode, follows an angularly displaced path, resulting in the creation of a magnetic field about the electron beam which in turn assists in focusing the electron beam.

DESCRIPTION OF THE DRAWINGS

A more thorough understanding of the invention may be obtained by a study of the following detailed description taken in connection with the accompanying drawings in which.

DESCRIPTION OF PREFERRED EMBODIMENT

Figure 1:
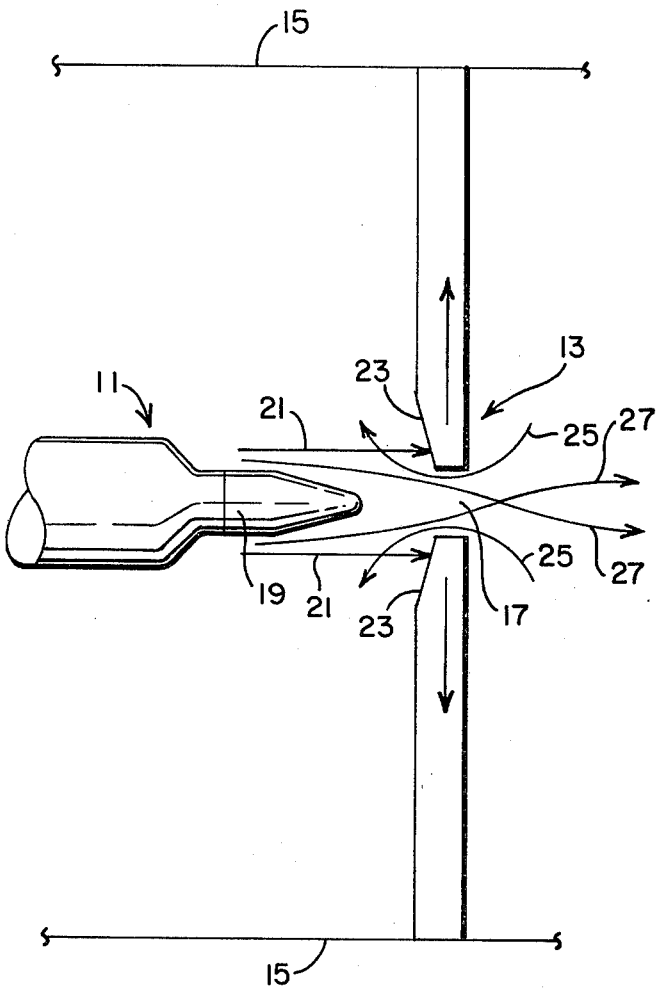
FIG. 1 is a simplified longitudinal cross-sectional view of an electron beam discharge device, showing the affect of a magnetic field produced by the electrode of the present invention on an electron beam.

Electron beams are used in a great many different applications. Some applications are sophisticated, such as a high energy charged particle accelerator, while others are relatively simple, such as an electron beam welding apparatus. The electron beam is typically generated by an electron beam discharge device. Referring to FIG. 1, all such devices have in common certain general elements, including a cathode 11, a high voltage pulse power supply (not shown) to energize the cathode so that it emits electrons, and an anode 13, which is positioned downstream of the cathode. The anode at its outer rim mates with a grounded wall 15 of the electron beam chamber. The anode 15 has an aperture 17 located typically central thereof, along the centerline of the device. The aperture 17 is configured, in size and outline, to provide the desired shape of the output electron beam. Primary control over the beam configuration is thus achieved by the opening 17 itself.

In operation, electrons are field emitted from the emission surface portion 19 of electrode 11, which is typically graphite, and are accelerated across the gap to the anode, generally in the area between the solid lines 21—21 in FIG. 1. The operating characteristics of the pulse power supply will vary from application to application. However, in the case of a high energy particle accelerator, the power may be supplied by a relativistic electron beam apparatus which produces electron beams of approximately 1–4 megavolts and 30–100 kiloamperes. Such a power supply produces a high energy electron beam.

A significant portion of the electrons field emitted from the surface of the cathode will proceed through the opening 17, forming a part of the output electron beam, but a significant portion will strike the near surface 23 of the anode 13 in the vicinity of the opening 17, as shown in FIG. 1. Although the various elements of FIG. 1 are arranged and configured so that a majority of the electrons proceed through the opening 17, there is no structure in current conventional electron beam devices which would tend to insure the movement of the electrons through the anode opening. The electrons from cathode 11 thus tend to follow an uninfluenced, somewhat random, path, leading either through the opening 17, or into the anode. Those electrons which do strike the anode 13, typically the near surface 23 thereof in the vicinity of opening 17, flow through the anode to the grounded wall 15, creating a return current path to ground. As discussed briefly above, however, a structure which relies only upon the dimensions and configurations of the anode aperture to control the electron beam will not provide the degree of beam focusing and beam uniformity required for many applications.

Figure 2:
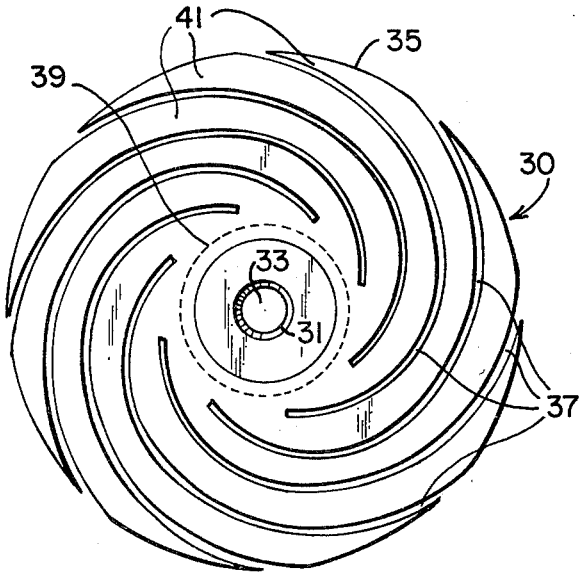
FIG. 2 is a front view of the electrode of the present invention.

The present invention, on the other hand, provides a positive control for the electron beam by creating an axial magnetic field about the beam, which has the effect of improving the focus, centering and uniformity characteristics of the beam. This magnetic field is achieved by the structure shown in FIG. 2. The structure is an anode, shown generally at 30, which has a general configuration similar to that of conventional electron beam discharge anodes, i.e. it is circular in outline, relatively thin compared to its diameter, with an inner rim 31, which defines a central aperture 33, and an outer rim 35 which mates with the grounded wall 15 of the electron beam discharge chamber. In the particular embodiment shown, the anode 30 has an inner diameter of 7/16ths inches, an outer diameter of 4½ inches and is ½ inch thick. These dimensions, of course, will vary depending upon the particular electron beam discharge device in which it is used. The anode is comprised of an electrically conducting material, in one specific example, aluminum.

Anode 30 is specially constructed with alternating regions of electrical conductance and electrical nonconductance which extend from the front flat surface to the rear flat surface, i.e. completely through, anode 30. These alternating regions are formed in a spiral-like configuration, when viewed head-on, so that electrical currents established in the regions of electrical conductance follow a spiral path. The alternating regions of electrical conductance and nonconductance extend from the vicinity of the inner rim 31 to the outer rim 35, so that the regions spiral about the center of the anode. Although a spiral configuration is preferred in some applications, it is not necessary that the regions be curved, as long as there is an angular displacement between the beginning and end points of the regions.

In the embodiment shown, the alternating regions of conductance and nonconductance are achieved by cutting a plurality of spiral slits 37 in the anode. These slits 37 are cut through the anode, and follow a one-half turn spiral path from their beginning point on an imaginary circle 39, which is approximately 1¾ inches in diameter, to their termination point at the outer rim 35 of the anode. Other spiral configurations, however, having a greater, or even lesser, amount of rotation may also be successfully used, as long as the currents in the anode follow an angularly displaced path. The greater the amount of rotation, the stronger the resulting magnetic field will be.

The slits 37 are approximately 1/16th inch wide, and approximately 4 inches long. The configurations of each slit is approximately a semi-circle. There are eight equally spaced slits in the embodiment shown, so that, for an anode having a diameter of approximately 4½ inches, the regions or vanes of electrical conductivity 41 between adjacent slits 29 are approximately ¼ inch wide over most of their lengths, and approximately 1½ inches wide at the outer rim 35. These dimensions, of course, will vary depending upon the diameter of the anode, and the particular configuration of the slits. Although the number of slits is not critical, the alternating regions of conductance and nonconductance should be symmetrical. Otherwise, the beam will not be centered properly.

The spiral vanes thus provide a plurality of separate spiral current paths for those electrons emitted from cathode 11 which strike the anode 30. The actual number of vanes, and their particular size, as noted above, will vary. Although the embodiments shown utilizes alternating vanes and slits, with the atmosphere providing the regions of electrical nonconductance between adjacent vanes, other structural configurations may be used to accomplish the desired alternating regions of conductance and nonconductance. For instance, the anode could be solid, with the materials comprising the anode defining the required alternating regions of electrical conductance and nonconductance. It is important, however, that the alternating regions be configured so that there is not a current path between adjacent electrically conducting regions, i.e. so that the return currents in the anode undergo an angular displacement prior to reaching ground.

In operation, at least some of the electrons emitted from cathode 11 will strike the near surface 23 of anode 13, which will result in multiple return currents in the anode, one in each vane 41, with each current path following an angularly displaced configuration, and in the embodiment shown, a spiral. The multiple spiral current paths in the anode 19 create a magnetic field about the centerline of the device in the vicinity of the opening 17. The outline of the effect of the magnetic field is shown representationally by the lines labeled 25 in FIG. 1.

The electron beam thus effectively is immersed in the magnetic field and is focused thereby, as shown by the lines 27—27 in FIG. 1, which shows the outline of the focused electron beam. The magnetic field created by the spiral currents is self-regulating in that the higher the current level of the electron beam and hence, the greater number of particles which hit the anode and the higher the spiral currents, the stronger the magnetic field, which thus provides increased focusing force on the high energy beam. Also, the strength of the magnetic field is affected by the amount of angular displacement of the electrically conducting regions, and hence the anode return currents. Generally, the greater the angular displacement, the stronger the focusing, although the system will at the same time tend to be more inductive, and will hence respond more slowly to changes in electron beam current levels.

By analogy, the magnetic field created by the spiral currents acts on the electron beam like a thin solenoid lens. The strength of the magnetic field thus can be estimated by the formula for a thin solenoid lens:

$$B = \pi n I / 5a$$

where B equals the magnetic field strength in gauss, n equals the number of turns, I equals the current in amperes, and a is the coil radius in centimeters. For an anode spiral ten centimeters in diameter in which each electrically conducting vane makes a one-half turn from start to finish, and where the total current in the vanes is 50K amperes, $$B = \frac{\pi\,(\frac{1}{2})\,(5 \times 10^4)}{5\,(10/2)}$$

$$B = 3.14 \times 10^3 \text{ gauss}$$

This example illustrates the fact that the magnetic field created by anodic spiral currents with a high current electron beam is quite strong, and has a strong focusing influence on even beams of 3 megavolts kinetic energy.

Likewise, the focal length of a thin magnetic lens of similar dimensions is illustrative of the strong focusing influence of the magnetic field. The focal length, i.e. the distance required for the magnetic field to focus the beam to a point, of the magnetic field which has an axial field strength of B along an axial distance d is:

$$f = 8 \times 10^9 \frac{mT}{eB_o^2 d}$$

where f equals the focal length of the lens in centimeters, m/e is equal to the electron mass/charge, T is equal to the electron kinetic energy in electron volts, B is equal to the magnetic field in gauss, and d is equal to the axial field effective length in centimeters. For the example given above, with a one megavolt electron kinetic energy level and an axial distance of one centimeter.

$$f = 8 \times 10^9 \frac{(5.8 \times 10^{-9} \text{ grams/coul.})\,(10^6 eV)}{(3.14 \times 10^3 \text{ gauss})^2\,(1\text{cm})}$$

$$f = 4.7 \text{ cm}$$

The above equations illustrate that magnetic fields created by spiral return paths are of a sufficient order to control and focus high energy electrons, on the order of several megavolts, within a reasonable distance from the magnetic field.

The present invention provides the spiral currents which establish the required magnetic field by use of an anode having spiral-shaped alternating regions of electrical conductance and nonconductance. The magnetic field as created is self-regulating in that it increases or decreases in strength in accordance with the current level of the electron beam. The magnetic field improves the flow of the electron beam, as it improves beam focusing, centering and uniformity.

Although a preferred embodiment of the invention has been disclosed herein for purposes of illustration, it will be understood that various changes, modifications and substitutions may be incorporated in such embodiment without departing from the spirit of the invention as defined by the claims which follow.

What is claimed is:

1. An electrode useful as an anode in an electron beam discharge device in which electrons are emitted from a cathode source, comprising:

electrode means, including means located in the vicinity of the outer rim of the electrode means for grounding the electrode means to the discharge device, said electrode means having an approximately central opening therein, through which electrons from the cathode source move, for forming an electron beam downstream of said electrode means, said electrode means further having regions of electrical conductance, separated by regions of electrical non-conductance, extending radially outwardly from the central opening and arranged so that the regions of electrical conductance are angularly displaced between their beginning points, which are located relatively towards the central opening and their termination points, which are located relatively away from the central opening in the vicinity of the outer rim of the electrode, so that in operation, an electrical current is established in the regions of electrical conductance by those electrons which strike said electrode means and follow an angularly displaced path to said grounding means, resulting in the creation of a magnetic field about the central opening, which assists in focusing the electrons emitted from the cathode source through the central opening to form the electron beam.

2. An article of claim 1, wherein the regions of electrical conductance are symmetrical about the opening, so that the beam tends to be centered in the opening.

3. An article of claim 1, wherein the regions of electrical conductance are curved.

4. An article of claim 1, wherein the electrode is generally disc-like in general configuration, having a diameter which is substantially greater than its thickness and including an inner boundary which defines the opening and an outer boundary, wherein the beginning points of the regions of electrical conductance are in the vicinity of said inner boundary and the termination points are at the outer boundary of said electrode means.

5. An article of claim 4, wherein the regions of electrical conductance and nonconductance extend completely through the electrode.

6. An article of claim 4, wherein the regions of electrical conductance are spiral-shaped, at least one-half turn in length.

7. An article of claim 1, wherein the regions of electrical nonconductance are substantially narrower than the regions of electrical conductance.

8. An apparatus of claim 1, wherein said regions of nonconductance are slit-like openings which extend completely through the electrode.

9. An apparatus of claim 8, wherein said slit-like openings define approximately a semi-circle.

10. An article of claim 1, wherein said regions of electrical nonconductance are of substantially equal size and are spaced substantially equally around the electrode.

11. An article of claim 1, wherein the central opening is approximately circular.

* * * * *